US007478790B2

(12) United States Patent
Yun

(10) Patent No.: US 7,478,790 B2
(45) Date of Patent: Jan. 20, 2009

(54) APPARATUS FOR SUPPORTING COMPRESSOR

(75) Inventor: Young-Hoon Yun, Daegu (KR)

(73) Assignee: LG Electronics Inc., Seoul (KR)

( * ) Notice: Subject to any disclaimer, the term of this patent is extended or adjusted under 35 U.S.C. 154(b) by 522 days.

(21) Appl. No.: 10/983,753

(22) Filed: Nov. 9, 2004

(65) Prior Publication Data

US 2005/0169775 A1 Aug. 4, 2005

(30) Foreign Application Priority Data

Jan. 30, 2004 (KR) ..... 10-2004-0006329

(51) Int. Cl.
*F16M 13/00* (2006.01)

(52) U.S. Cl. ..... 248/624; 248/622; 248/623; 248/677

(58) Field of Classification Search ..... 248/622, 248/623, 624, 618, 617, 615, 575, 560, 677, 248/188.8, 188.9
See application file for complete search history.

(56) References Cited

U.S. PATENT DOCUMENTS

| | | | | | |
|---|---|---|---|---|---|
| 886,227 | A * | 4/1908 | Mamet et al. | 280/283 |
| 956,618 | A * | 5/1910 | Baltzley | 248/624 |
| 1,119,300 | A * | 12/1914 | Mesinger | 297/211 |
| 1,711,085 | A * | 4/1929 | D Arcy | 248/560 |
| 1,988,295 | A * | 1/1935 | Berry | 248/568 |
| 2,175,784 | A * | 10/1939 | Rosenzweig | 248/623 |
| 2,222,724 | A * | 11/1940 | Rogers | 248/624 |
| 2,687,270 | A * | 8/1954 | Robinson | 248/565 |
| 2,949,324 | A * | 8/1960 | Birge et al. | 403/229 |
| 2,979,297 | A * | 4/1961 | Suozzo | 248/542 |
| 4,722,505 | A * | 2/1988 | Kaiser | 248/561 |
| 4,731,966 | A * | 3/1988 | Fujita et al. | 52/167.1 |
| 4,771,989 | A * | 9/1988 | Smith | 267/33 |
| 4,871,300 | A * | 10/1989 | Outzen | 417/363 |
| 5,342,179 | A * | 8/1994 | Dreiman | 417/363 |
| 5,913,892 | A * | 6/1999 | Kwon | 62/296 |
| 6,004,113 | A * | 12/1999 | Vay | 417/363 |
| 6,079,690 | A * | 6/2000 | Yoon | 248/622 |
| 2004/0168464 | A1 * | 9/2004 | Seo et al. | 62/295 |

FOREIGN PATENT DOCUMENTS

| | | |
|---|---|---|
| JP | 09-195938 A | 7/1997 |
| JP | 2000-136395 | 5/2000 |
| JP | 2001-050179 | 2/2001 |
| JP | 2002-295582 | 10/2002 |

* cited by examiner

*Primary Examiner*—J. Allen Shriver, II
*Assistant Examiner*—Michael McDuffie
(74) *Attorney, Agent, or Firm*—Birch, Stewart, Kolasch & Birch, LLP

(57) ABSTRACT

A support apparatus comprises: a first support member connected to the compressor; a second support member disposed at a predetermined interval from the first support member and fixed to a base; a spring disposed between the first support member and the second support member, of which both ends are contacted with the first support member and the second support member to be supported thereby; and at least one connection member connecting the first support member and the second support member so that the spring is not separated from between the first support member and the second support member. Accordingly, the spring is prevented from being moved or buckled by vibration of the compressor, or both ends of the spring are prevented from being detached from the support members, so that support performance and vibration preventing effect for the compressor can be improved.

4 Claims, 5 Drawing Sheets

APPARATUS FOR SUPPORTING COMPRESSOR

BACKGROUND OF THE INVENTION

1. Field of the Invention

The present invention relates to a support apparatus for supporting compressor, and more particularly, to a support apparatus capable of improving support performance and vibration preventing effect.

2. Description of the Background Art

As shown in FIG. 1, a conventional support apparatus for supporting a compressor includes a first support member 120 connected to a bracket 12 extended from one side of a compressor 10 by being inserted in a coupling hole 14 formed in the bracket 12; a second support member installed at a base 16 to which the compressor 10 is supported at a predetermined interval from the first support member 120; a fixing shaft 60 penetrating each central portion of the first support member 120 and the second support member 130 and fixed to the base 16; and a spring 140 interposed between the first support member 120 and the second support member 130, for supporting the compressor 10 and also absorbing the vibration of the compressor 10.

The first support member 120 is formed with a head portion 124 inclined at a predetermined angle along a circumference of an upper portion of the first support member 120 so that the first support member 120 can be smoothly inserted in the coupling hole 14 of the bracket 12; and a bracket fixing portion 126 recessed in a radial direction of the first support member 120 so that an inner circumference of the coupling hole 14 of the bracket 12 is inserted therein.

Each of the first and second support members 120 and 130 is made of an elastic ingredient such as rubber. The first and second support members 120 and 130 have shaft holes 128 and 138 at central portions thereof in which the fixing shaft 60 is inserted; and spring support grooves 123 and 133 respectively formed at surfaces facing the spring 140 so that both ends of the spring 140 are respectively inserted and coupled thereto.

The fixing shaft 60 has a ring groove 62 recessed at an upper portion thereof so that a snap ring 64 for preventing the first support member 120 from being separated from the fixing shaft 60 is inserted therein.

However, the conventional support apparatus has the following problems.

Namely, since the first support member 120 and the second support member 130 are separately fabricated, and both ends of the spring 140 are inserted into the spring support grooves 123 and 133 by relatively high force, fabrication and assembling processes of the support apparatus are complicated.

In addition, in case that a displacement of the spring 140 more than a certain value occurs due to excessive vibration of the compressor 10 or external force, both ends of the spring 140 are easily separated from the spring support grooves 123 and 133.

SUMMARY OF THE INVENTION

Therefore, an object of the present invention is to provide a support apparatus capable of improving support performance and vibration preventing effect for a compressor by making a fabricating and assembling process easy and preventing a spring from being separated when a compressor is vibrated.

To achieve these and other advantages and in accordance with the purpose of the present invention, as embodied and broadly described herein, there is provided a support apparatus comprising: a first support member connected to the compressor; a second support member disposed at a predetermined interval from the first support member and fixed to a base; a spring disposed between the first support member and the second support member, of which both ends are contacted with the first support member and the second support member to be supported thereby; and at least one connection member connecting the first support member and the second support member so that the spring is not separated from between the first support member and the second support member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

First Embodiment

Figure 1:
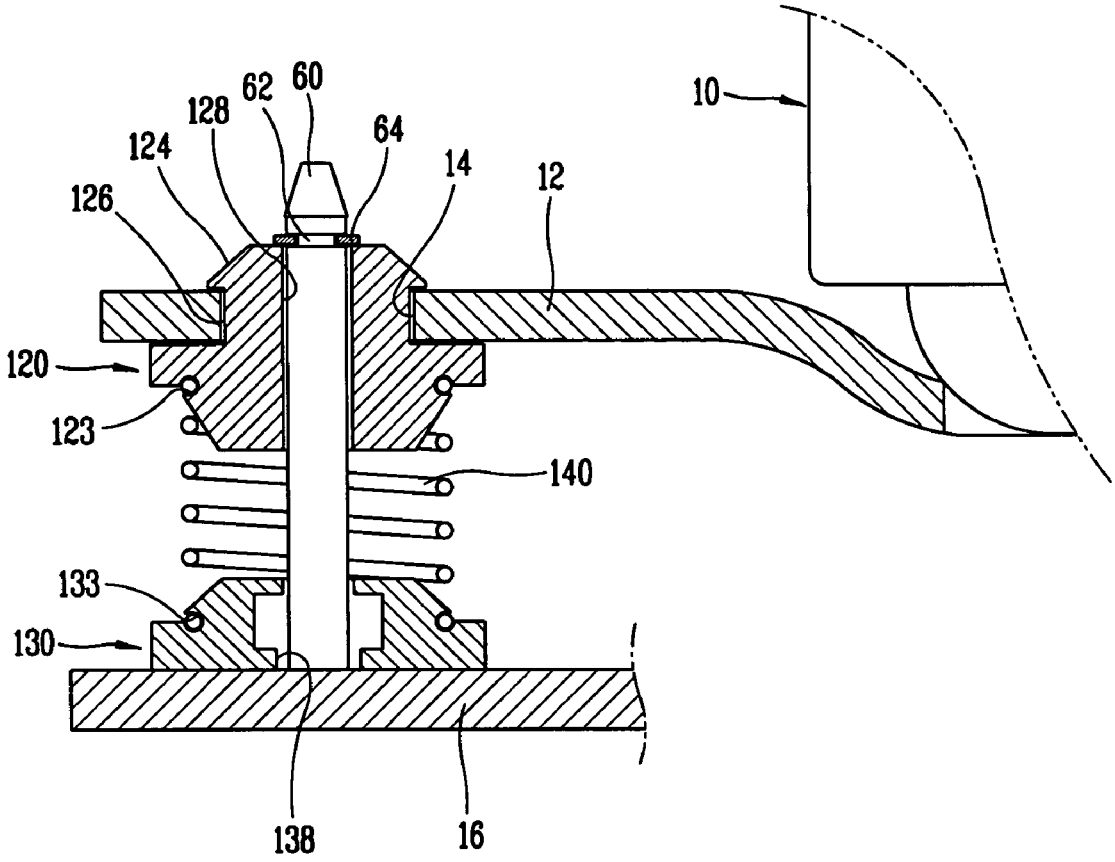
FIG. 1 BACKGROUND ART
FIG. 1 is a sectional view showing a conventional support apparatus.
Figure 2:
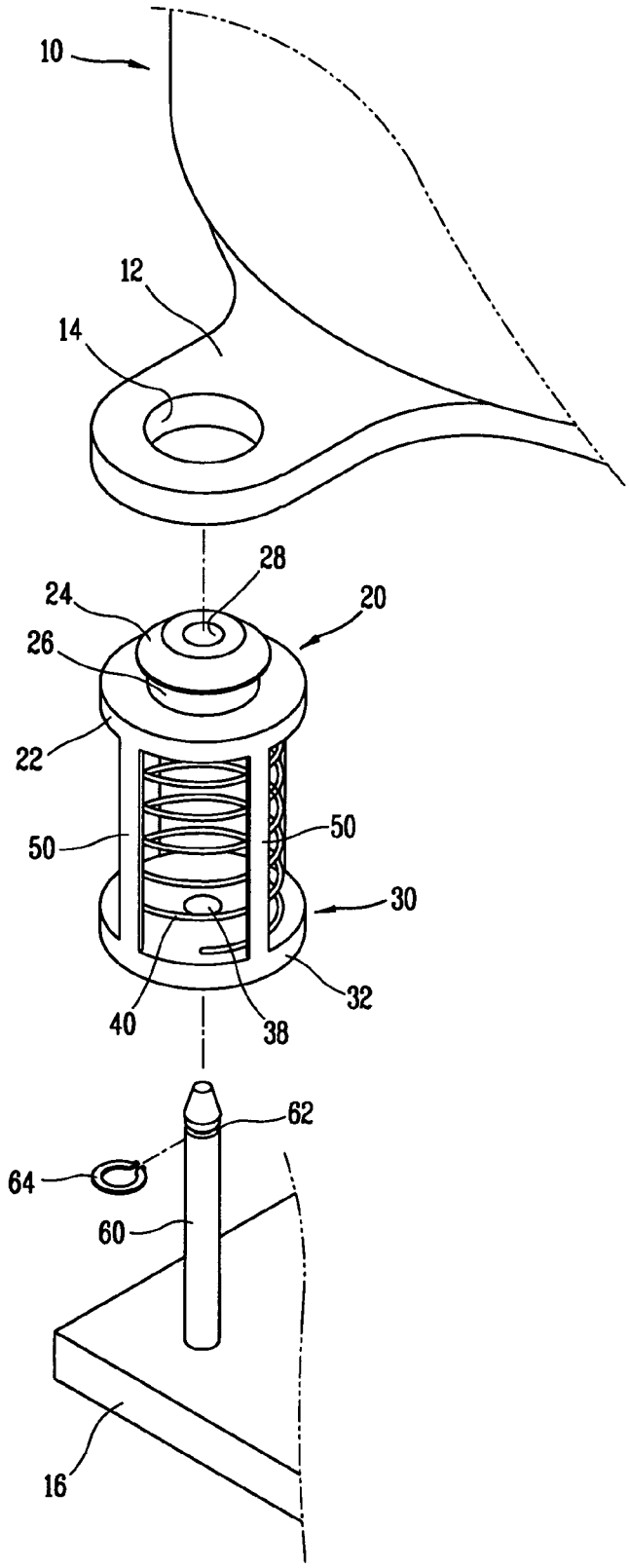
FIG. 2 is a exploded perspective view showing a support apparatus in accordance with a first embodiment of the present invention.
Figure 3:
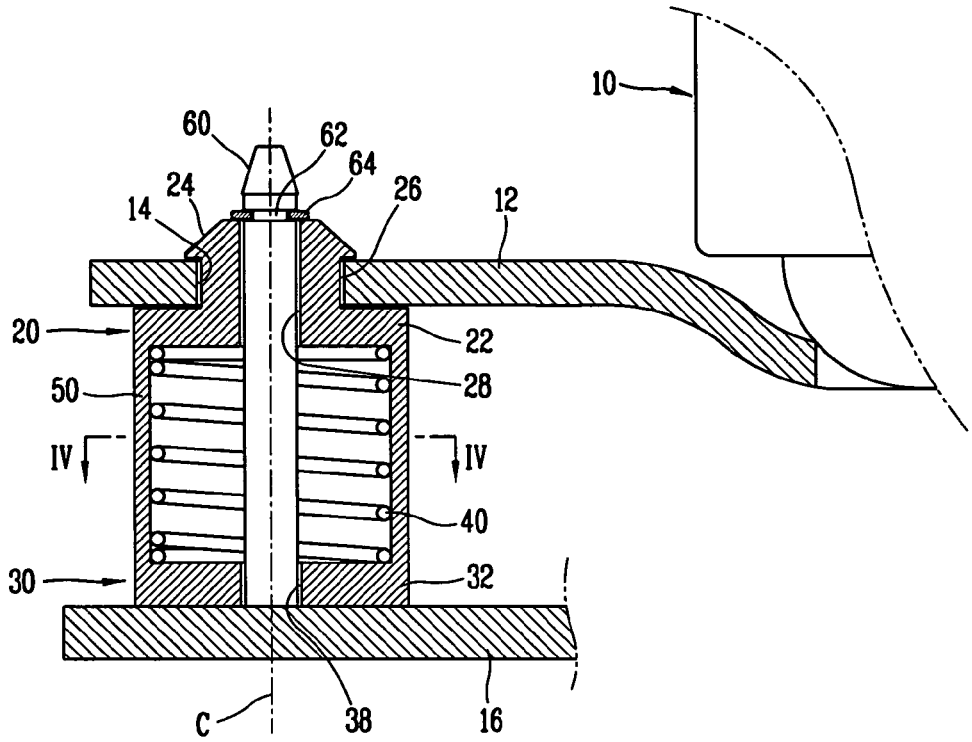
FIG. 3 is a sectional view showing a support apparatus in accordance with a first embodiment of the present invention.
Figure 4:
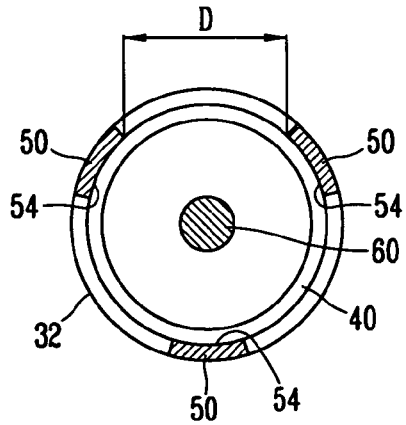
FIG. 4 is a sectional view taken along line IV-IV of FIG. 3.

As shown in FIGS. 2 to 4, a support apparatus in accordance with a first embodiment of the present invention includes: a first support member 20 connected to a bracket 12 extended from one side of a compressor 10 by being inserted at a coupling hole 14 formed at the bracket 12; a second support member 30 disposed at a predetermined interval from the first support member 20 and fixed to a base 16 to which the compressor 10 is supported; a fixing shaft 60 penetrating central portions of the first support member 20 and the second support member 30 and fixed to the base 16; a spring 40 disposed between the first support member 20 and the second support member 30 and having both ends contacted with the first support member 20 and the second support member 30, respectively to be supported thereby, for supporting the compressor 10 and absorbing vibration of the compressor 10; and at least one connection member 50 installed between the first support member 20 and the second support member and integrally connecting the first support member 20 and the second support member 30.

The first support member 20 includes: a spring support portion 22 substantially formed in a disc shape and supporting one end of the spring 40 by being contacted therewith; a head portion 24 formed at one side of the spring support portion 22, which faces a coupling hole 14 of the bracket 12 and having a surface inclined at a predetermined angle along its circumference so that the first support member 20 can be smoothly inserted in the coupling hole 14; and a bracket fixing portion 26 inwardly recessed between the spring support portion 22 and the head portion 24 in its radial direction so that an inner circumference of the coupling hole 14 of the bracket 12 is inserted therein. In addition, a penetrating hole 28 through which the fixing shaft passes is formed at a central portion of the first support member 20.

The head portion 24 of the first support member 20 is formed of a material having elasticity such as synthetic resin so as to be inserted into the coupling hole 14 of the bracket 12. A surface of the spring support portion 22 of the first support member 20, which comes in contact with one end of the spring 40 may be formed as a plane.

The second support member 30 includes a spring support portion 32 substantially formed in a disc shape and supporting one end of the spring 40 by being contacted therewith and having a central portion where a penetrating hole 38 through which the fixing shaft 60 passes is formed. A surface of the spring support portion 32 of the second support member 30, which comes in contact with the other end of the spring 40, may be formed as a plane.

The fixing shaft 60 includes a ring groove 62 recessed along a circumference of the fixing shaft 60 so as to be coupled to the first support member 20. A snap ring 64 is inserted at the ring groove 62to thereby prevent the first support member 20 from being detached from the fixing shaft 60. The fixing shaft 60 is coupled and fixed to the base 16 through a method such as an engagement means such as a screw or the like, welding or the like.

The connection member 50 is extended from the spring support portion 22 of the firsts support member 20 toward the spring support portion 32 of the second support member 30. Preferably, the connection member 50 is integrally fabricated with the first and second support members 20 and 30.

In addition, preferably, a plurality of connection member 50 are formed along circumferences of the first and second support members 20 and 30. In this case, the plurality of connection members 50 are made of an elastic material. Accordingly, in case the spring 40 is interposed between the first and second support member 20 and 30, the connection member 50 is elastically deformed as the spring 40 advances thereinto and so distances between the connection members 50 become wider. Thus, the spring 40 passes between the connection members 50 and is interposed between the first and second support members 20 and 30.

In addition, after the spring 40 is completely interposed between the first and second support members 20, the connection member 50 maintains its initial state by its elastic characteristic.

When the compressor 10 is vibrated, the connection member 50 prevents the spring 40 from being moved in a direction perpendicular to its central axis (C) or from being buckled, or prevents both ends of the spring 40 from being detached from the spring support portions 22 and 32 of the first and second support members 20 and 30.

Accordingly, preferably, the connection member 50 is installed such that its inner surface 54 facing a central axis (C) of the spring 40 is contacted with an outer circumference of the spring 40. Here, preferably, the inner surface 40 of the connection member 50, which faces the central axis (C) of the spring 40 is formed in a curved surface having the same curvature as the outer circumference of the spring 40.

Hereinafter, a process for installing the support apparatus in accordance with the first embodiment of the present invention as above between the compressor 10 and the base 16 will now be described.

First, the first and second support members 20 and 30 and the connection member 50 are integrally fabricated. When the spring 40 is inserted between the connection members 50, the connection members 50 are properly and elastically deformed so that the spring 40 is inserted between the first and second support members 20 and 30. Here, both ends of the spring 40 are respectively supported by the spring support portions 22 and 32 of the first and second support members 20 and 30 by coming in contact therewith, and an outer circumference of the spring 40 is supported by an inner surface of the connection member 50 by coming in contact therewith.

And, when the head portion 24 of the first support member 20 is inserted into the coupling hole 14 of the bracket 12, an inner circumference of the coupling hole 14 is inserted into the bracket fixing portion 26 of the first support member 20. Accordingly, the first support member 20 is fixed to the bracket 12.

And, the fixing shaft 60 is fixed to the base 16 and inserted into the penetrating holes 28 and 38 of the first and second support members 20 and 30. Then, the snap ring 64 is coupled to the ring groove 62 of the fixing shaft 60. In such a manner, an installation of the support apparatus in accordance with the first embodiment of the present invention is completed.

The support apparatus in accordance with the first embodiment of the present invention, constructed and installed as described above, includes an elastic connection member 50 that integrally connects the first and second support members 20 and 30 to which both ends of the spring 40 are respectively supported. For this reason, the spring 40 is prevented from being moved in direction perpendicular to its central axis (C) or from being buckled, or both ends of the spring 40 are prevented from being detached from the spring support portions 22 and 32 of the first and second support members 20 and 30.

Second Embodiment

Hereinafter, with reference to FIG. 5, a support apparatus in accordance with a second embodiment of the present invention will now be described. The same reference numerals will be given to the same parts as the above-mentioned first embodiment, and descriptions thereabout will now be omitted.

As for a support apparatus in accordance with the second embodiment of the present invention, spring support grooves 25 and 35 in which parts of both ends of the spring 40 are respectively inserted are respectively formed at surfaces of the spring support portions 22 and 32 of the first and second support members 20 and 30 for respectively supporting both ends of the spring 40, which are contacted with both ends of the spring 40.

When projected on plane, the spring support grooves 25 and 35 are formed in a ring shape so that both ends of the spring 40 are inserted therein. Preferably, a width of the spring support groove 25, 35 is formed to be the same as or smaller than a thickness of the spring 40.

That is, both ends of the spring 40 are inserted in the spring support grooves 25 and 35 formed at the spring support portions 22 and 32 of the first and second support members 20 and 30 to thereby support the spring 40. Accordingly, the support apparatus in accordance with the second embodiment of the present invention has advantages in that the spring 40 is prevented from being moved in a direction perpendicular to the central axis (C) of the spring 40, more firmly.

Figure 5:
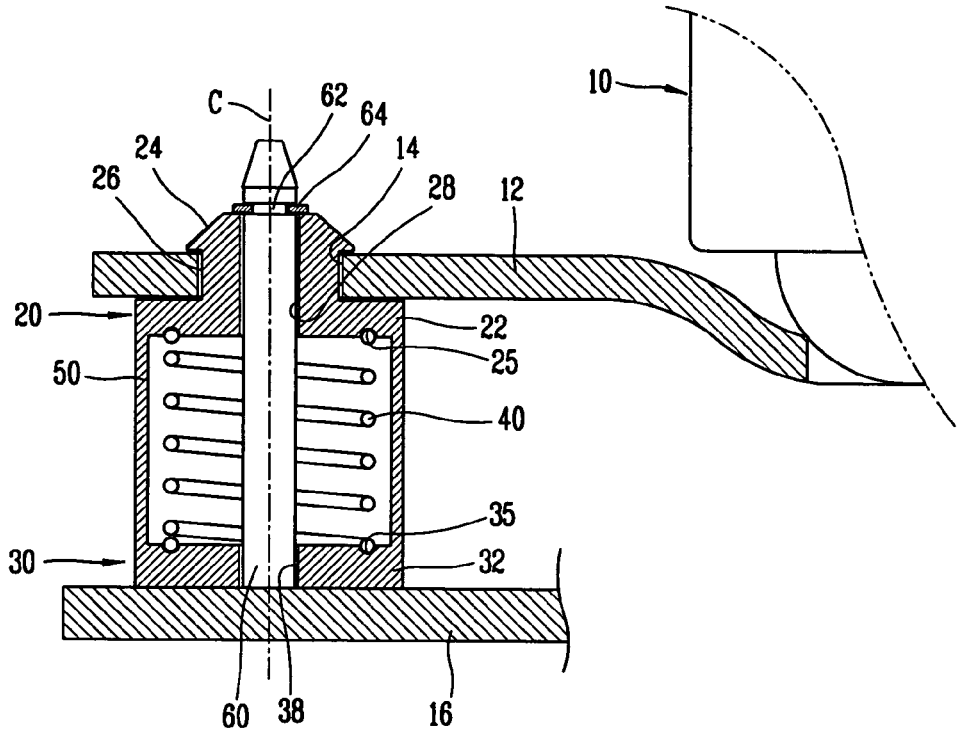
FIG. 5 is a sectional view showing a support apparatus in accordance with a second embodiment of the present invention.

As shown in FIG. 5, in the support apparatus in accordance with the second embodiment of the present invention, the movement of the spring 40 is primarily prevented by the spring support grooves 25 and 35. Accordingly, the spring 40 can be installed at a slight interval from an inner surface 54 of the connection member 50 without coming in contact with the inner surface 54 of the connection member 50. That is, the spring support groove 25, 35 may be formed at a predetermined interval from the inner surface of the connection member 50.

Hereinafter, a process for installing a support apparatus in accordance with the second embodiment of the present invention and its effect are substantially the same as the first embodiment.

Third Embodiment

Figure 6:
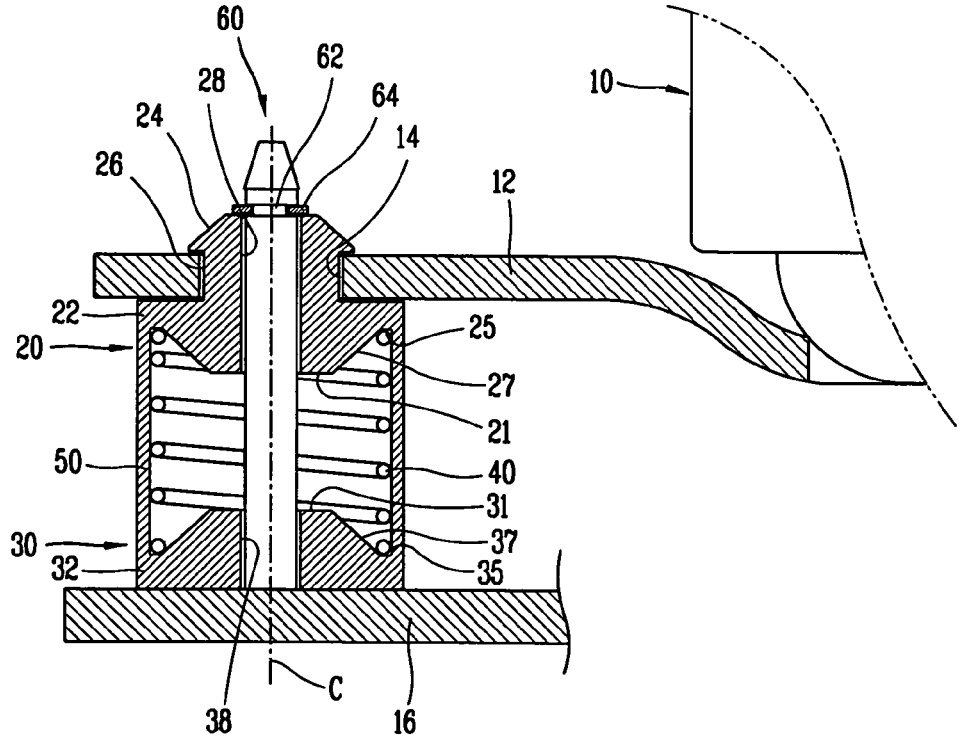
FIG. 6 is a sectional view showing a support apparatus in accordance with a third embodiment of the present invention.

Hereinafter, a support apparatus in accordance with a third embodiment of the present invention will now be described with reference to FIG. 6. The same reference numerals will be given to the same parts as the above-mentioned embodiments, and descriptions thereabout will now be omitted.

As for a support apparatus in accordance with the third embodiment of the present invention, a spring support groove 25 in which a part of one end of the spring 40 is inserted is formed at a surface of a spring support portion 22 of a first support member 20, which is contacted with one end of the spring 40. In order to prevent movement of the spring 40, a protruded portion 21 protruded in a direction that the first and second support members 20 and 30 face into each other is formed from the spring support groove 25 toward a central axis (C) of the spring 40.

In addition, a spring support groove 35 in which a part of the other end of the spring 40 is inserted is formed at a surface of a spring support portion 32 of the second support member 30, which is contacted with the other end of the spring 40. A protruded portion 31 protruded in a direction that the first and second support members 20 and 30 face into each other is formed from the spring support groove 35 toward the central axis (C) of the spring 40.

In such a structure, the spring is inserted between the first and second support members 20 and 30 in a state of being compressed, and both ends of the spring 40 are inserted in the spring support grooves 25 and 35 while being stretched.

Accordingly, preferably, in order to compress the spring 40 while the spring 40 is inserted between the first and second support members 20 and 30, guide surfaces 27 and 37 inclined to the spring support grooves 25 and 35 are respectively formed at outer circumferences of the protruded portions 21 and 31. When the spring 40 is inserted and then stretched, the guide surfaces 27 and 37 of the protruded portions 21 and 31 make both ends of the spring 40 smoothly inserted in the spring support grooves 25 and 35.

In addition, preferably, ends of the protruded portions 21 and 31, to which the guide surfaces 27 and 37 are connected, are formed as a plane perpendicular to the central axis (C) of the spring 40 so that the spring 40 can be smoothly inserted between the first and second support members 20 and 30.

The spring support groove 25, 35 may be formed at a predetermined interval from an inner surface of the connection member 50 as the above-mentioned second embodiment. Also, as shown in FIG. 6, the spring support groove 25, 35 may be formed by formation of the connection member 50 and the protruded portions 21, 31. Here, the outer circumference of the spring 40 and the inner surface of the connection member 50 are in contact with each other.

A process for installing the support apparatus in accordance with the third embodiment of the present invention and its effect are substantially the same as the above mentioned embodiments.

Fourth Embodiment

Figure 7:
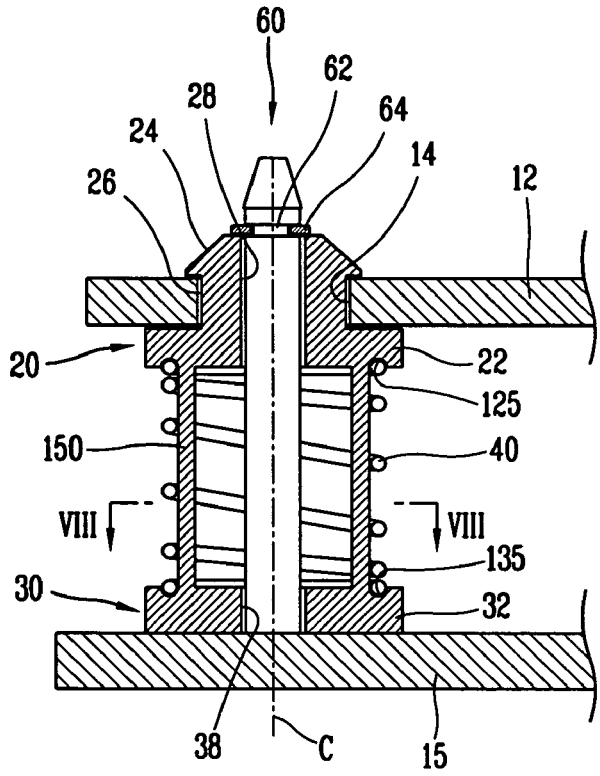
FIG. 7 is a sectional view showing a support apparatus in accordance with a fourth embodiment of the present invention.
Figure 8:
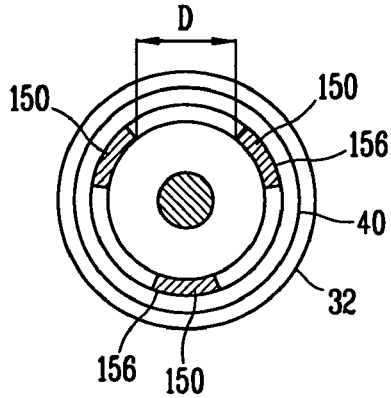
FIG. 8 is a sectional view taken along line VIII-VIII of FIG. 7.

Hereinafter, a support apparatus in accordance with a fourth embodiment of the present invention will now be described with reference to FIGS. 7 and 8. The same reference numerals will be given to the same part as the above-mentioned embodiments, and descriptions thereabout will now be omitted.

A support apparatus in accordance with a fourth embodiment of the present invention includes: a first support member 2 connected to a bracket 12; a second support member 30 disposed at a predetermined interval from the first support member 20 and fixed to a base 16 supporting a compressor; a fixing shaft 60 penetrating central portions of the first support member 20 and the second support member 30 and fixed to the base 16; a spring 40 disposed between the first support member 20 and the second support member 30 and having both ends contacted with the first support member 20 and the second support member 30 to be supported thereby and absorb vibration of the compressor; and at least one connection member 150 disposed inside an inner circumference of the spring 40 and integrally connecting the first support member 20 and the second support member 30.

Preferably, the connection member 150 is installed such that its outer surface 156 and an inner circumference of the spring 40 are contacted with each other. Preferably, the outer surface 156 of the connection member 50 is formed in a curved surface having the same curvature as curvature of the inner circumference of the spring 40.

Surfaces of the spring support portions 22 and 32 of the first and second support members 20 and 30, which are contacted with both ends of the spring 40 may be formed as a plane. However, preferably, in order to more firmly prevent the movement of the spring 40, spring support grooves 125 and 135 in which parts of both ends of the spring 40 are inserted are formed at the spring support portions 22 and 32.

A process for installing the support apparatus in accordance with the fourth embodiment of the present invention and its effect are substantially the same as the above-mentioned embodiments.

As so far described, as for a support apparatus in accordance with the present invention, an elastic connection member for connecting support members to which both ends of a spring are respectively supported is provided, so that the spring is prevented from being moved or buckled by vibration of a compressor, or both ends of the spring are prevented from being detached from the support members. Accordingly, support performance and vibration preventing effect for the compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for supporting a compressor, comprising:

a bracket connected to a compressor;

a first support member coupled to the bracket;

a second support member disposed at a predetermined interval from the first support member and fixed to a base;

a spring disposed between the first support member and the second support member, and having both ends contacting the first and second support members so as to be supported thereby;

one or more connection members formed of an elastic material, for connecting the first support member and the second support member with each other such that the spring is not separated from the first and second support members; and a fixing shaft inserted into the spring, the first support member, and the second support members, and having one end fixed to the base, wherein the first support member comprises:

a spring support portion formed in a disc shape and supporting one end of the spring by contacting thereto;

a head portion formed at one side of the spring support portion, facing a coupling hole of the bracket, and having a surface inclined by a predetermined angle along a circumference thereof such that the first support member is smoothly inserted in the coupling hole;

a bracket fixing portion inwardly recessed between the spring support portion and the head portion; and a penetrating hole formed at a central portion of the first support member such that the fixing shaft passes therethrough.

2. An apparatus for supporting a compressor, comprising:

a bracket connected to a compressor;

a first support member coupled to the bracket;

a second support member disposed at a predetermined interval from the first support member and fixed to a base;

a spring disposed between the first support member and the second support member, and having both ends contacting the first and second support members so as to be supported thereby;

one or more connection members formed of an elastic material, for connecting the first support member and the second support member with each other such that the spring is not separated from the first and second support members; and a fixing shaft inserted into the spring, the first support member, and the second support members, and having one end fixed to the base, wherein the connection members each have a first end and a second end, the first end being nonmovably fixed to the first support member, and the second end being nonmovably fixed to the second support member.

3. An apparatus for supporting a compressor, comprising:

a bracket connected to a compressor;

a first support member coupled to the bracket;

a second support member disposed at a predetermined interval from the first support member and fixed to a base;

a spring disposed between the first support member and the second support member, and having both ends contacting the first and second support members so as to be supported thereby;

one or more connection members formed of an elastic material, for connecting the first support member and the second support member with each other such that the spring is not separated from the first and second support members; and a fixing shaft inserted into the spring, the first support member, and the second support members, and having one end fixed to the base, wherein the fixing shaft has a central longitudinal axis, and wherein the connection members are elastically deformable in a direction substantially parallel to said longitudinal axis.

4. An apparatus for supporting a compressor, comprising:

a bracket connected to a compressor;

a first support member coupled to the bracket;

a second support member disposed at a predetermined interval from the first support member and fixed to a base;

a spring disposed between the first support member and the second support member, and having both ends contacting the first and second support members so as to be supported thereby;

one or more connection members formed of an elastic material, for connecting the first support member and the second support member with each other such that the spring is not separated from the first and second support members; and a fixing shaft inserted into the spring, the first support member, and the second support members, and having one end fixed to the base, wherein a length of the connection members decreases and increases as the spring is compressed and extended, respectively.

* * * * *